United States Patent [19]

Colin

[11] 4,397,257

[45] Aug. 9, 1983

[54] SEA ANCHOR IN PARTICULAR FOR LARGE SHIPS

[75] Inventor: Armand Colin, Versailles, France

[73] Assignee: Agence Nationale de Valorisation de la Recherche (ANVAR), Paris, France

[21] Appl. No.: 176,246

[22] Filed: Aug. 7, 1980

[30] Foreign Application Priority Data

Aug. 7, 1979 [FR] France ..... 79 20214

[51] Int. Cl.[3] ..... B63B 21/44

[52] U.S. Cl. ..... 114/304

[58] Field of Search ..... 114/294, 295, 298, 299, 114/301, 303, 304, 305, 306, 307, 308, 309, 310;

[56] References Cited

U.S. PATENT DOCUMENTS

| | | | |
|---|---|---|---|
| 957,621 | 5/1910 | Neal | 114/306 |
| 2,200,695 | 5/1940 | Kaut | 114/304 |
| 4,173,938 | 11/1979 | Colin | 114/294 |

FOREIGN PATENT DOCUMENTS

| | | | |
|---|---|---|---|
| 242975 | 1/1912 | Fed. Rep. of Germany | 114/307 |
| 2231561 | 12/1974 | France | 114/298 |
| 331084 | 6/1930 | United Kingdom | 114/304 |
| 608801 | 9/1948 | United Kingdom | 114/301 |

*Primary Examiner*—Trygve M. Blix
*Assistant Examiner*—Jesús D. Sotelo
*Attorney, Agent, or Firm*—Wenderoth, Lind & Ponack

[57] ABSTRACT

The anchor comprises a shank and a rocker which is mounted in the vicinity of one end of the shank to pivot about an axis perpendicular to the shank and to the rocker and which has two equal branches constituting the arms of the anchor. Each arm carries at its free end a ploughshare whose convergent end portion faces the other end of the shank. The convex faces of the two ploughshares are disposed in confronting relation. In operation, the anchor operates in the same way as conventional so-called "plough" anchors in hard grounds, whereas the two ploughshares sink into and simultaneously operate in very soft grounds.

8 Claims, 9 Drawing Figures

SEA ANCHOR IN PARTICULAR FOR LARGE SHIPS

The present invention relates to a sea anchor, in particular for large ships of the type comprising a coupling device which includes at least one shank, and a rocker which is pivoted in the vicinity of one end of the coupling device to pivot about an axis perpendicular to the longitudinal plane of symmetry of the anchor and has two branches constituting the arms of the anchor and extending on each side of the coupling device.

An anchor of this type is known which is called the Porter anchor and comprises a rectilinear shank extended by a fork in which the rocker is pivotally mounted. This anchor was designed for the purpose of overcoming certain drawbacks of ordinary stock anchors, one of which was that the mooring line has a tendency to wind itself around the arm of the anchor projecting above the bottom of the sea when the ship turned around its anchor, which could cause the latter to be pulled out of the bottom, and the other that this projecting arm could pierce the hull in the case of vessels having a low water line moored in shallow waters The rocker of the Porter anchor is arranged in such way that when one of the arms is engaged with the bottom of the sea, the other arm is folded along the shank so that these dangers can be, as a rule, avoided.

U.S. Pat. Nos. 2,245,807 and 2,200,695 disclose anchors whose design is similar to that of the Porter anchor but in respect of which the ends of the rocker are provided as the stock anchors with spades or flukes constituted by planar surfaces stiffened by ribs.

All these anchors have characteristics similar to that of the anchors having a stock which, as the Porter anchor, are no longer employed for a long time owing to their low anchoring power.

Other anchor models have been used since then but many trials and a certain number of accidents have shown that the models of anchor at present employed for large and very large ships do not have the desired behaviour in the various mooring conditions that the ships may encounter. Thus, with anchors of several hundreds of kilos, favoured consequently by their anchoring force/weight efficiency ratio there has been found an anchoring force between three times the weight of the anchor in mud and nine times this weight in sand. Moreover, these anchors for large ships show an incapacity to penetrate a hard underlayer instability, a slowness to grip and no resistance to traction in respect of a direction of this traction making only 10° slope relative to the surface of the terrain in which the anchor is hooked. As, moreover, the efficiency ratio decreases when the weight of the anchor increases, i.e. this increase, which constitutes a drawback from the point of view of handling and cost in particular, does not result in a corresponding increase in the anchoring power and this explains why very large ships can hardly expect much help from their anchors.

U.S. Pat. No. 4,173,938 discloses two anchors and an anchoring system whereby it is possible to employ these anchors separately or in combination so as to obtain the maximum of efficiency in all possible varieties of terrain, considered on the surface and in thickness. One of these anchors having an anchoring element of the ploughshare type is suitable for soft to very hard terrains whereas the other having an anchoring element of the "sheet" type, is more suitable for soft and very soft terrains. These two anchors derive their efficiency not directly from the embedding effect resulting from an increase in their weight, but from a geometry specially studied for the terrains encountered thereby.

However, the effective use of the anchors disclosed U.S. Pat. No. 4,173,938 is related to the knowledge of the nature of the terrains in which they must penetrate. Now, if this requirement does not constitute an obstacle in the case of floating vessels such as, for example, drilling platforms, dredges, landing stages, river crossing installations for rivers having a rapid current etc . . . in respect of which the mooring site is always studied previously, this is not the case for large ships which cannot benefit from long primary studies of the terrains. Furthermore, the anchors mentioned hereinbefore are anchors of the so-called "positioning" type which only act by a single engaging side and are consequently non reversible and which must be placed on the bottom of the sea in the correct position. This is ensured by an auxiliary ship in the case of the aforementioned floating vessels, but is unsuitable for ships which may have need to moor rapidly while they have a certain speed.

Indeed, an essential quality that an anchor must have for a ship is to be reliable, i.e. it must offer a certainty of maximum operation under all situations that the ship may encounter and in particular when the ship is moving under the action of the wind and currents. In order to have this reliability, the anchor must in particular satisfy the following requirements:

engagement under an oblique traction and not only a horizontal traction;

engagement with a small amount of slip even on hard terrains;

penetration in all grounds and not only soft grounds;

capacity of engagement irrespective of the side on which the anchor has come into contact with the bottom of the sea;

a stability which is as great as possible;

prohibition of a lateral auto-stability in the position of dragging on the side;

aptitude to behave well with short lengths of the mooring line and under exceptional traction forces;

anchoring force which is as constant as possible in the various varieties of terrains encountered on the surface and in depth, namely hard, soft and very soft terrains;

a weight which is as low as possible.

An object of the invention is to provide a polyvalent anchor which satisfies as far as possible the aforementioned requirements.

The invention provides a sea anchor of the aforementioned type, wherein each arm carries at its free end a plough whose convergent end portion is oriented toward the other end of the coupling device, the convex faces of the two ploughs being disposed in confronting relation.

According to one feature of the invention, the anchor comprises abutment means defining two extreme positions between which the rocker may pivot and the ploughs are fixed to the arms in such relative disposition that in each of the extreme positions, considered in said longitudinal plane of the symmetry, one of the ploughs is spaced away from the coupling device and has its face opposed to its edge which diverges relative to said device, whereas the convergent end portion of the other plough is placed in the immediate vicinity of the coupling device and the face of the other plough, which is opposed to its edge, converges toward the coupling device.

According to another feature of the invention, the angle $\theta$ that the face of the plough adjacent the coupling device makes with a median plane of the coupling device containing the pivot axis exceeds the angle $\phi$ that the face of the other plough makes with this median plane.

According to a further feature of the invention, the anchor comprises at least two rockers which are connected to the coupling device by a connecting device and whose pivot axes are in alignment.

Further features and advantages of the invention will be apparent from the ensuing description of various embodiments which are given solely by way of example and illustrated in the accompanying drawings in which.

Figure 1:
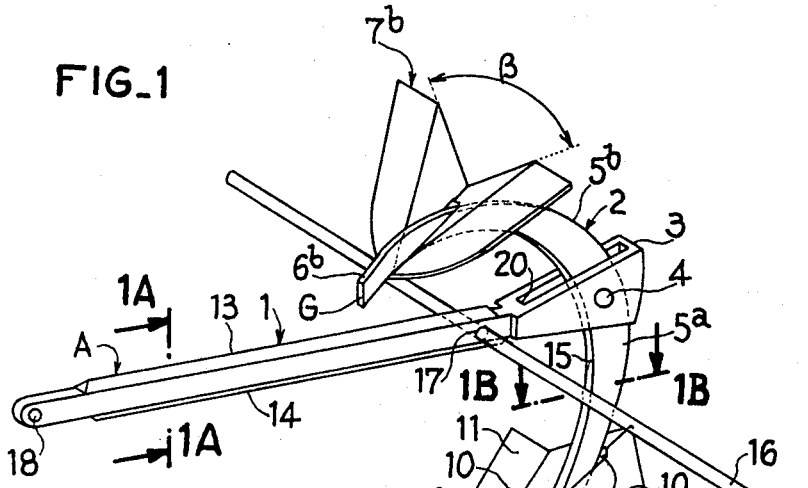
FIG. 1 is a perspective view of an anchor according to the invention comprising a single shank.
Figure 2:
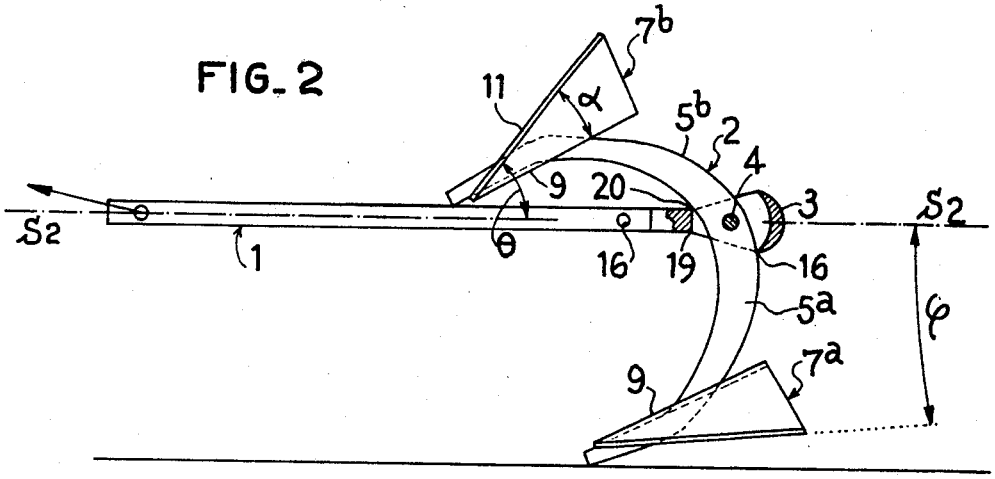
FIG. 2 is a side elevational view, partly in section, of the anchor of FIG. 1.

With reference first to FIGS. 1 and 2, the illustrated anchor comprises a coupling device A formed by a rectilinear shank 1 and a rocker 2 which are symmetrical relative to a common longitudinal plane. The rocker 2 is mounted to pivot about a pivot pin 4 perpendicular to the plane of symmetry in a fork 3 disposed at one end of the shank 1. The rocker 2 has preferably an arcuate shape and its concavity faces the shank 1. This rocker has two equal branches **5*a* and 5*b* constituting the arms of the anchor and each terminating in a substantially rectilinear portion 6*a*, 6*b* which is cranked inwardly of the concavity of the rocker 2** relative to the adjacent curved portion of the arm.

Each of the arms **5*a* and 5*b* carries a plough or ploughshare 7*a* and 7*b* respectively formed by a dihedron having a profile in the shape of a pyramid. The convex sides of the ploughs 7*a* and 7*b* face each other and each of the arms extend toward the interior of the concavity of the dihedron of the corresponding plough through a slot 8 formed along the edge 9 of the dihedron. The rectilinear part 6*a*, 6*b* of the arms extends inside the concavity of the corresponding plough along the edge 9 of the latter and its free end G projects beyond the front edge of the plough so as to form a claw for gripping rocks. This rectilinear portion 6*a*, 6*b* of the arm is fixed to the side faces 10** of the dihydron by any suitable means, for example by welding. Further, the dihedron may be stiffened by reinforcements.

The side faces 10 of the plough are extended outwardly by flanges 11 disposed in a common plane perpendicular to the bisecting plane of the dihedron, this bisecting plane constituting the common plane of symmetry for the shank, the rocker and the ploughs. The edge 9 is inclined relative to the plane of the flanges 11 at an angle $\alpha$ between 10° and 45° approximately and preferably between 20° and 35° from the rear edge of the dihedron toward the front edge adjacent to the end G forming a claw. Further, the lateral faces 10 of the dihedron make therebetween an angle $\beta$ preferably equal to about 90°. The convergent end 12 of the plough may either be closed, as shown in the drawing, or truncated.

Figure 1A:
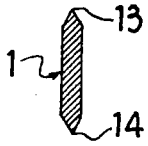
FIG. 1A is a sectional view taken on line 1A—1A of FIG. 1.
Figure 1B:
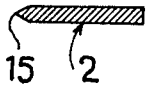
FIG. 1B is a sectional view taken on line 1B—1B of FIG. 1.

In order to facilitate the penetration in the terrain, the shank 1 has in the plane of symmetry S of the anchor, two opposite edges 13 and 14 which are preferably bevelled as shown in section in FIG. 1A. The corresponding edges of the fork 3 are also bevelled as is the inner edge 15 of the rocker 2 which is on its concave side as is clear from the sectional view of FIG. 1B.

The anchor of FIGS. 1 and 2 is completed by a stock 16 which extends through an aperture 17 in the shank 1. The presence of this stock is required in the case of an anchor having a single shank in order to ensure the turning over. An aperture 18 is provided at the free end of the shank 1 so as to permit the fixing of the anchor-ring of a mooring line.

The rocker 2 may pivot about the pin 4 between two extreme positions which are determined by the abutment, on the one hand, of the inner edge 15 of the arms **5*a* and 5*b* respectively against the edges of the front edge 19 and 20 of the fork 3 and, on the other hand, of the claw G of the arms 5*a* and 5*b* against the edges 14 and 13 respectively of the shank 1. FIGS. 1 and 2 show one of these extreme positions in which it is the arm 5*b*** which is in abutment.

In these extreme positions, if the anchor is viewed in a plane perpendicular to its pivot axis 4 as is the case of FIG. 2, for example in its longitudinal plane of symmetry, the plane of the flanges 11 of the plough **7*a* spaced from the shank diverges from the shank 1 whereas the plane of the flanges 11 of the other plough 7*b* adjacent the shank converges toward the latter. Of course, a similar but inverted arrangement is found if it is the arm 5*a* which is in bearing relation to the shank 1. This relative disposition of these ploughs is important since, as will be seen hereinafter, they enable the two ploughs to operate simultaneously in the case of the complete embedding of the anchor in a soft or very soft ground. Further, this relative disposition of the ploughs is preferably such that, in the two extreme positions of the rocker, the angle $\theta$ that the plane of the flanges 11 of the plough adjacent the shank makes with the median plane $S_2$—$S_2$ of the shank containing the pivot pin 4 exceeds the angle $\phi$ that the plane of the flanges 11** of the other plough makes with the plane $S_2$—$S_2$. The angle $\theta$ may be between 35° and 50° approximately and is preferably equal to 40° and the angle $\phi$ may be between about 10° and 20° and is preferably equal to 12°.

Figure 3:
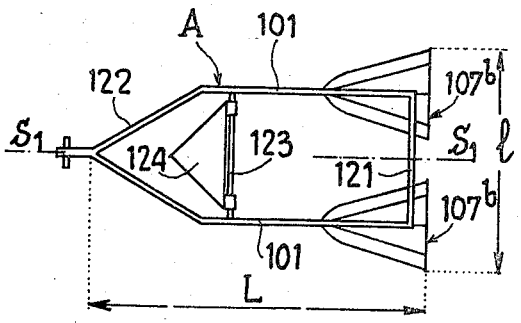
FIG. 3 is a plan view of an anchor according to the invention whas has two shanks and two rockers.

Reference will now be made to FIG. 3 in which the same reference numerals as those of FIGS. 1 and 2 increased by the number 100 have been employed for designating corresponding elements. This FIG, 3 shows diagramatically an anchor which is symmetrical relative to the longitudinal plane of the line $S_1$—$S_1$ and which comprises two shanks 101 which are fixed to be parallel to each other in the vicinity of each of their ends and each carry a rocker and ploughs identical to those just described, the pivot pins of the two rockers being in alignment. More precisely, the forks disposed at the ends of the two shanks 101 are rigidly interconnected by a connecting device constituted by a rectilinear cross member 121, whereas these shanks are interconnected at their other end by a fork-shaped member 122 which forms with the shanks the coupling device A of the anchor. A pin 123 extends between the shanks 101 and carries a flap 124 which is pivotable between the branches of the fork member 122, between two extreme positions defined by abutments (not shown). In operation, this flap does not have directly for function to increase the maintaning force, but it achieves this indirectly by retarding the moment when the shanks 101 are raised by the reaction of the terrain in which they are embedded on the cable or the chain of the mooring line.

Figure 4:
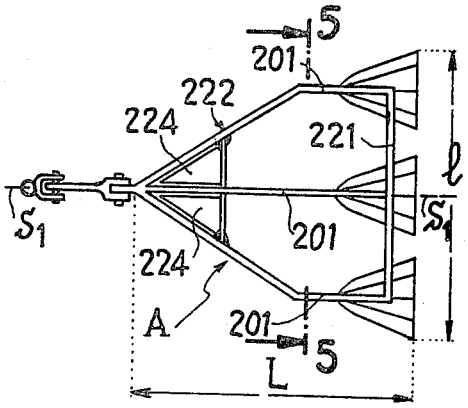
FIG. 4 is a plan view of another anchor according to the invention having three shanks and three rockers.

FIG. 4 shows another modification in which the reference numerals of FIGS. 1 and 2 have been increased by the number 200 in order to designate similar parts. This anchor differs essentially from that of FIG. 3 by the fact that it comprises three shanks 201, each carrying a rocker and ploughs identical to those described with respect to FIGS. 1 and 2. The forks of the three shanks are interconnected by a cross-member 221 and the shanks are united at their other end by a fork-shaped member having three branches 222 which completes the coupling device A of the anchor. Flaps 224 perform the same function as the flap 124 and are pivotally mounted between the pairs of adjacent branches of the fork 222.

Figure 5:
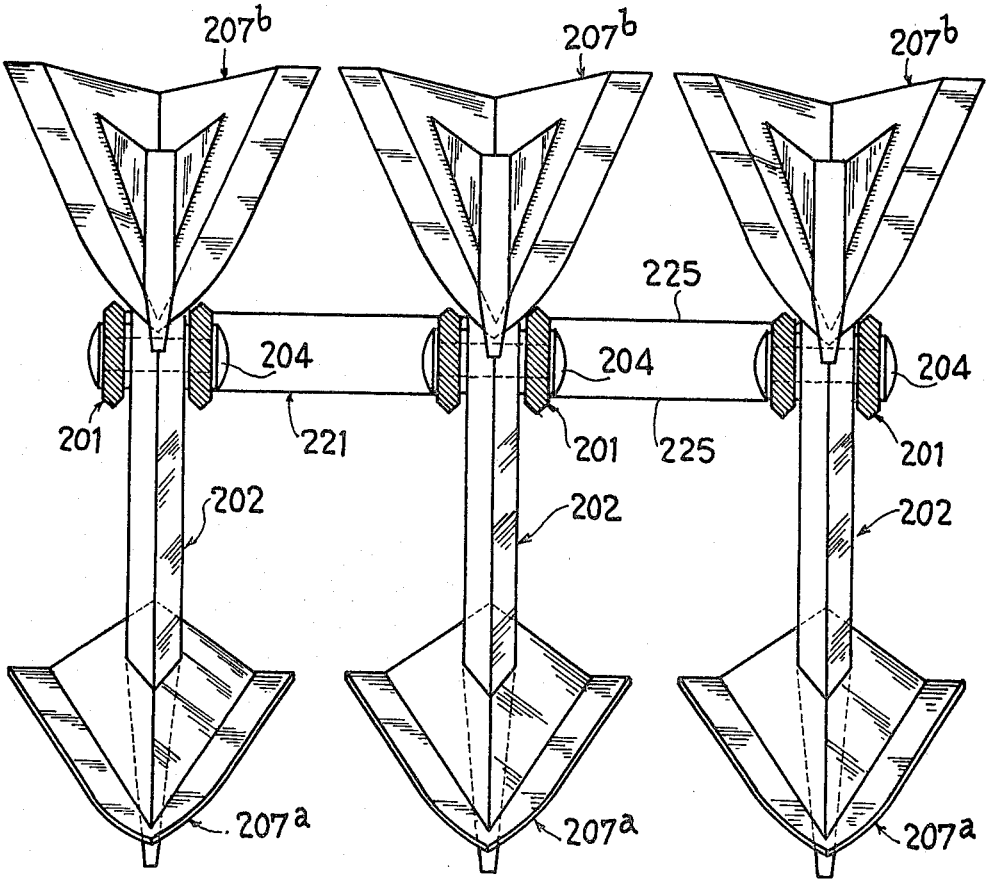
FIG. 5 is a sectional view to an enlarged scale taken on line 5—5 of FIG. 4.

The sectional view of FIG. 5 shows in a more detailed manner the embodiment of an anchor having three shanks of the type shown in FIG. 4, it being understood that, apart from the number of shanks and rockers, the following description is also valid for the anchor of FIG. 3. The rectilinear girder 221 has a concave shape, its concavity facing the shanks 201, so as to form an additional retaining surface. Further, the longitudinal edges of the cross member 221 are preferably formed by sharp lip portions 225 in order to facilitate the penetration of the girder in the terrain.

However, it will be observed that, in the case of an anchor having a plurality of rockers, it is unnecessary that the shanks be parallel to each other. They may extend obliquely from the forks and coincide then with the branches of the fork-shaped member. Further, in this case also, the shanks of the coupling device may be directly fixed to the cross-member and not to the forks, and the number of shanks may differ from that of the rockers. The connecting device between the forks is not limited to a rectilinear cross-member but may have any shape suitable to ensure a rigid mounting of the forks so that the pivot pins of the rockers are parallel or in alignment.

Figure 6:
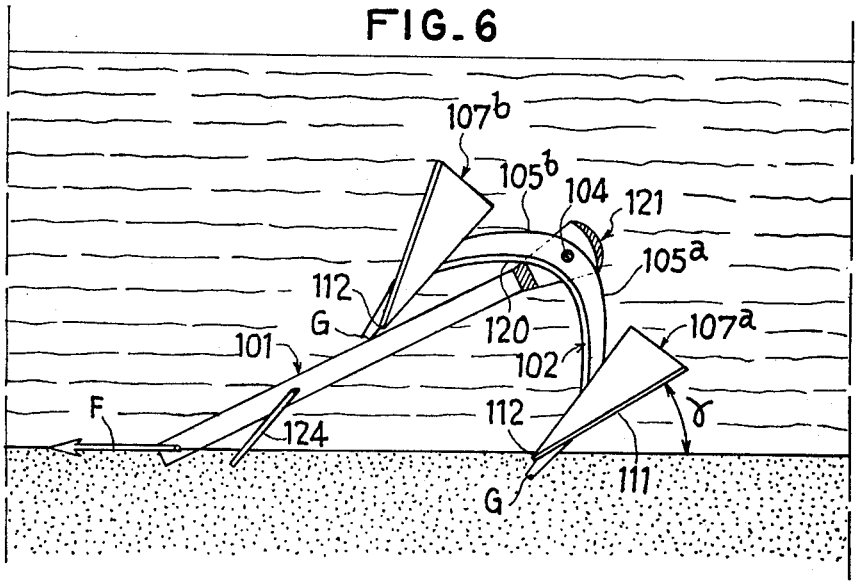
FIG. 6 is a side elevational view, partly in section, of an anchor according to the invention, viewed at the start of the stage of its penetration in a terrain.
Figure 7:
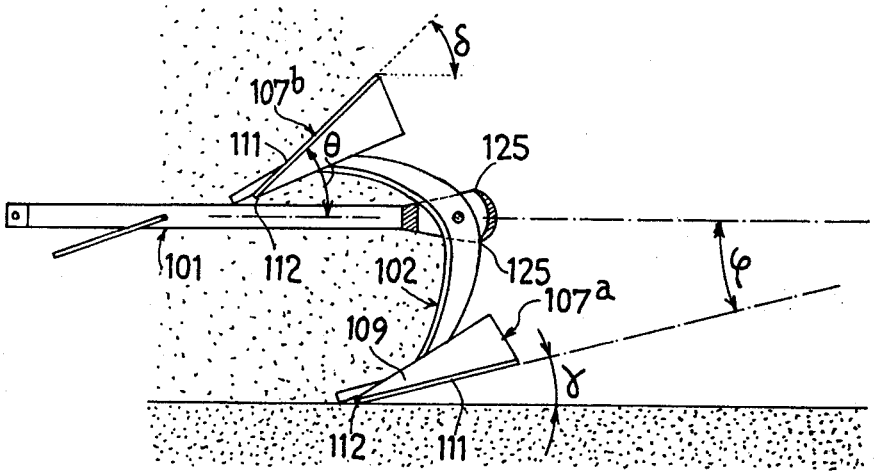
FIG. 7 is a view similar to FIG. 5 but showing the anchor after it has penetrated and become completely embedded in a very soft terrain.

With reference now to FIGS. 6 and 7 which illustrate the operation of the anchor according to the invention, it will be assumed that it concerns the anchor having two shanks and two pairs of ploughs of FIG. 3, it being however noted that the operation of the anchor having three shanks of FIG. 4 would be absolutely identical.

Indeed, these two anchors have an intrinsic stability owing to the magnitude of the width l of their span relative to the length L so that, even if these anchors are placed on one side on the sea bottom, they have a tendency to tip to the anchoring position shown in FIGS. 3 and 4 when they are subjected to a traction. In the case of the anchor of FIG. 1, this lateral stability is ensured by the stock 16; the anchor then places itself on the bottom at three points, namely the end of the shank 1 connected to the mooring line (not shown), one of the ends of the stock 16 and one of the ploughs 7*a* and 7*b*. As soon as a traction is exerted on the anchor, one of the flanges of the plough in contact with the bottom digs into the latter and this plough starts to embed itself and straightens the stock to the horizontal position. Consequently, whether it concerns the anchor having a stock or an anchor having a plurality of pairs of ploughs, the anchor is in the position shown in FIG. 6 at the start of the embedding stage.

It can be seen in this FIG. 6 that the attacking edges of the flanges 111 of the plough or ploughshare 107*a* in contact with the terrain, attack the latter at an angle $\gamma$ which ensures the embedding, even in compact grounds. It will be observed that the claw G projecting relative to the end of the plough, permits avoiding damage to its end 112 and its attacking edges if the plough encounters a rocky bottom. Owing to the traction exerted in the direction of arrow F on the shank 101, the latter straightens as the plough 111 becomes embedded in the ground, which also straightens the embedded plough 107*a* owing to the fact that the claw G of the arm 5*b* has come into abutment with the shank 101 and the fact that the inner edge of this arm 5*b* has abutted against the edge 20. This straightening of the shank 101 is delayed by the action of the flap 124 which therefore promotes the sinking in of the anchor, but nonetheless continues until the shank 101 reaches a horizontal position as shown in FIG. 7.

In this position, the angle $\gamma$ has a value less than that it had at the start of the sinking in stage (FIG. 6) and equal to the angle $\phi$, this value being however sufficient for maintaining the anchor embedded in opposition to the reaction that the terrain exerts upwardly on this anchor and which results from the traction due to the mooring line.

Experience has shown that in very compact terrain, the anchor sinks in to a level located slightly above the pivot pin 104, i.e. the shank 101 is also slightly embedded. As the other anchors of the plough type, the anchor according to the invention then ensures a very good performance which, for a given weight, is very improved relative to that of these conventional anchors owing to the additional resistance offered by the surface of the flanges 111. Another advantage of these flanges is that, if the ultimate strength of the metal of which they are composed is reached, they deform without the anchor letting go, so that the anchor continues to brake the movement of the ship. On the other hand, with a conventional anchor, either the latter is liable to let go, or the mooring line is liable to break. Further, in the case of an anchor having shovels, the latter break. Lastly, this characteristic of elasticity of the unit comprising the mooring line and the anchor is still further increased by the fact that, in the extreme case mentioned hereinbefore, the faces 10 of the dihedron tend to close toward each other, either elastically without permanent deformation or beyond the elastic limit of the metal with a permanent deformation, which permits in both cases absorbing a part of the traction force exerted by the mooring line while maintaining the engagement of the anchor.

If the anchor operates in a softer terrain, it continues to sink in until the other plough 107*b* also starts to penetrate the terrain. If the terrain is very soft, the anchor may completely sink into the terrain as shown in in FIG. 7. It then shows its advantage over other anchors of the prior art owing to the fact that there is added to the resistance to the traction offered by the convex face of the lower plough or ploughshare 107*a* and by the concave face of the cross-member 121, the resistance due to the concave face of the upper plough 107*b* which operates relative to the horizontal at an angle $\delta$ exceeding $\gamma$, and equal to $\theta$ when the shank is horizontal. Consequently, in very short terrain, the active surfaces of the plough 107*a*, of the girder 121 and of the plough or ploughshare 107*b* intervene in succession and provide, not a single angle of operation, but a group of angular dispositions which are so arranged as to promote the capacities of penetration, sinking in and behaviour of the anchor.

Owing to the successive entry into action of the aforementioned active surfaces, the anchor provides a roughly constant anchoring force irrespective of the nature of the terrain encountered, in respect of which it considerably differs from conventional polyvalent anchors which have in fact behaviour characteristics which vary considerably with the nature of the terrains.

It must be understood that many modifications may be made in the anchor described without departing from the scope of the invention as defined in the claims. Thus, there may be any number of rockers and pairs of ploughs, the choice of this number being related in particular to the required anchoring force and to the available space for placing the anchor. Further, the anchor according to the invention is not limited to the geometrical shapes described hereinbefore, although the anchor described constitutes a preferred embodiment. Even if, owing to its qualities, the anchor according to the invention is particularly suitable for large ships, its application is of course not limited to this type of ship.

Having now described my invention what I claim as new and desire to secure by Letters Patent is:

1. A sea anchor comprising a coupling device which has at least one shank and at least one rocker which is mounted in the vicinity of a first end of the coupling device to pivot about an axis perpendicular to a longitudinal plane of symmetry of the anchor and which has two branches constituting arms of the anchor which extend on opposite sides of the coupling device from the pivot axis to free ends of the arms, a ploughshare carried by each arm adjacent the free end of the arm, the ploughshare having a convex side and an opposed concave side in cross-sectional planes perpendicular to said longitudinal plane of symmetry and a convergent substantially pointed end portion which substantially faces a second end of the coupling device opposed to said first end, said convex sides of the two ploughshares being disposed in confronting relation to each other, said ploughshares forming dihedral structures, each having a profile in the shape of a pyramid, said ploughshares having two flanges which extend outwardly relative to lateral portions of the dihedral structures in a common plane perpendicular to a bisecting plane of the dihedral structures.

2. A sea anchor comprising a coupling device which has at least one shank and at least one rocker which is mounted in the vicinity of a first end of the coupling device to pivot about an axis perpendicular to a longitudinal plane of symmetry of the anchor and which has two branches constituting arms of the anchor which extend on opposite sides of the coupling device from the pivot axis to free ends of the arms, a ploughshare carried by each arm adjacent the free end of the arm, the ploughshare having two outer edges which are disposed on opposite sides of said longitudinal plane of symmetry and are substantially convergent from an end of the ploughshare toward the corresponding arm to a substantially pointed end which substantially faces a second end of the coupling device opposed to said first end and a convex side and an opposed concave side in cross-sectional planes perpendicular to said longitudinal plane of symmetry, the convex side of the two ploughshares being disposed in confronting relation to each other, abutment means for abutment by the rocker in two extreme positions of the rocker as it pivots about said axis, the ploughshares defining a corner edge which is located on said convex side thereof and contained in said longitudinal plane of symmetry and the ploughshares being fixed to the arms in such a relative disposition that said outer edges of the two ploughshares, when viewed in a direction parallel to said pivot axis, are convergent in a direction away from said first end of the coupling device and, in each of said extreme positions of the rocker, a first of the ploughshares is spaced away from the coupling device and said outer edges of said first ploughshare diverge relative to the coupling device substantially in the direction of said second end of the coupling device and the substantially pointed end of a second of said ploughshares is located in the immediate vicinity of the coupling device, and said outer edges of said second ploughshare converge toward the coupling device substantially in the direction of said second end of the coupling device, said ploughshares forming dihedral structures, each having a profile in the shape of a pyramid, said ploughshares having two flanges which extend outwardly relative to lateral portions of the dihedral structures in a common plane perpendicular to a bisecting plane of the dihedral structures.

3. An anchor as claimed in claim 1, or claim 2, wherein a slot is formed along an edge of the dihedral structures and said arms extend through the slot and have a rectilinear portion fixed to the interior of the dihedral structures along said edges.

4. An anchor as claimed in claim 3, wherein the rectilinear portion of the arms projects beyond said convergent end portion of the ploughshares and forms a claw for engaging rocks.

5. A sea anchor comprising a coupling device which has at least one shank and a plurality of rockers each of which rockers is mounted in the vicinity of a first end of the coupling device to pivot about an axis perpendicular to a longitudinal plane of symmetry of the anchor and has two branches constituting arms of the anchor which extend on opposite sides of the coupling device from the pivot axis to free ends of the arms, a ploughshare carried by each arm adjacent the free end of the arm, the ploughshare having a convergent end portion which faces a second end of the coupling device opposed to said first end and a convex side in cross-sectional planes perpendicular to said longitudinal plane of symmetry, the convex sides of the two ploughshares being disposed in confronting relation to each other, a connecting device which connects the rockers to the coupling device, the pivot axes of the rockers being in alignment with each other, the coupling device comprising a fork-shaped member having a plurality of branches and at least a pivotable flap disposed between two adjacent branches of the fork-shaped member.

6. An anchor as claimed in claim 5, wherein the connecting device comprises a rectilinear cross-member having a concave side which faces the coupling device.

7. An anchor as claimed in claim 5, wherein the connecting device comprises a rectilinear cross-member which has sharp edge portions extending longitudinally of the cross-member.

8. A sea anchor comprising a coupling device which has at least one shank and at least one rocker which is mounted in the vicinity of a first end of the coupling device to pivot about an axis perpendicular to a longitudinal plane of symmetry of the anchor and which has two branches constituting arms of the anchor which extend on opposite sides of the coupling device from the pivot axis to free ends of the arms, a ploughshare carried by each arm adjacent the free end of the arm, the ploughshare having convergent substantially pointed end portion which faces a second end of the coupling device opposed to said first end and a convex side and an opposed concave side in cross-sectional planes perpendicular to said longitudinal plane of symmetry, the convex sides of the two ploughshares being disposed in confronting relation to each other, abutment means for abutment by the rocker in two extreme positions of the rocker as it pivots about said axis, the ploughshares defining a corner edge on said convex side thereof and being fixed to the arms in such a relative disposition that in each of said extreme positions of the rocker, considered in said longitudinal plane of symmetry, a first of the ploughshares is spaced away from the coupling device and the convergent end portion of a second of said ploughshares is located in the immediate vicinity of the coupling device, each ploughshare comprising a dihedral structure having substantially the shape of a pyramid when viewed in a direction perpendicular to said longitudinal plane of symmetry, said dihedral structure comprising two substantially planar portions which make an angle of substantially 90° therebetween in a transverse plane of the ploughshare, and each ploughshare having two opposed lateral flanges extending laterally outwardly from the dihedral structure and substantially contained in a common plane, the common plane of said first ploughshare making an angle of substantially 10°–20° and the common plane of said second ploughshare making an angle of substantially 35°–50° with a plane containing the coupling device and said pivot axis in said extreme positions of the rocker.

* * * * *